US008206245B2

(12) United States Patent
Kamino et al.

(10) Patent No.: US 8,206,245 B2
(45) Date of Patent: Jun. 26, 2012

(54) GOLF BALL

(75) Inventors: Kazuya Kamino, Kobe (JP); Keiji Ohama, Kobe (JP); Hirotaka Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 141 days.

(21) Appl. No.: 12/397,707

(22) Filed: Mar. 4, 2009

(65) Prior Publication Data

US 2009/0258731 A1 Oct. 15, 2009

(30) Foreign Application Priority Data

Apr. 15, 2008 (JP) ..... 2008-105217

(51) Int. Cl.
*A63B 37/06* (2006.01)

(52) U.S. Cl. ..... 473/376

(58) Field of Classification Search ..... 473/376, 473/368

See application file for complete search history.

(56) References Cited

U.S. PATENT DOCUMENTS 5,688,595 A 11/1997 Yamagishi et al.
6,354,967 B1 * 3/2002 Nakamura et al. ..... 473/378
7,131,915 B2 * 11/2006 Sullivan et al. ..... 473/376
2002/0119840 A1 8/2002 Higuchi et al.
2004/0029648 A1 2/2004 Kato
2005/0075196 A1 4/2005 Shimizu et al.
2006/0270492 A1 11/2006 Higuchi et al.
2007/0111823 A1 5/2007 Higuchi et al.

FOREIGN PATENT DOCUMENTS

JP 8-336617 A 12/1996

* cited by examiner

*Primary Examiner* — Raeann Gorden

(74) *Attorney, Agent, or Firm* — Birch, Stewart, Kolasch & Birch, LLP

(57) ABSTRACT

A golf ball 2 includes a core 4, an envelope layer 6, a mid layer 8 and a cover 10. A thickness Tm of the mid layer 8 is less than 1.2 mm. A thickness Tc of the cover 10 is less than 0.6 mm. The sum of the thicknesses Tm and Tc is equal to or less than mm. A hardness Hs of the envelope layer 6 is 50 or greater. A hardness Hm of the mid layer 8 is 30 or greater and 60 or less. A hardness Hc of the cover 10 is less than 40. The hardness Hs, the hardness Hm, and the hardness Hc satisfy the following formula (1).

$$Hs \geqq Hm \geqq Hc \quad (1)$$

The base material of the envelope layer 6 is ionomer resin. The base material of the midlayer 8 is polyurethane. The base material of the cover 10 is polyurethane.

10 Claims, 1 Drawing Sheet

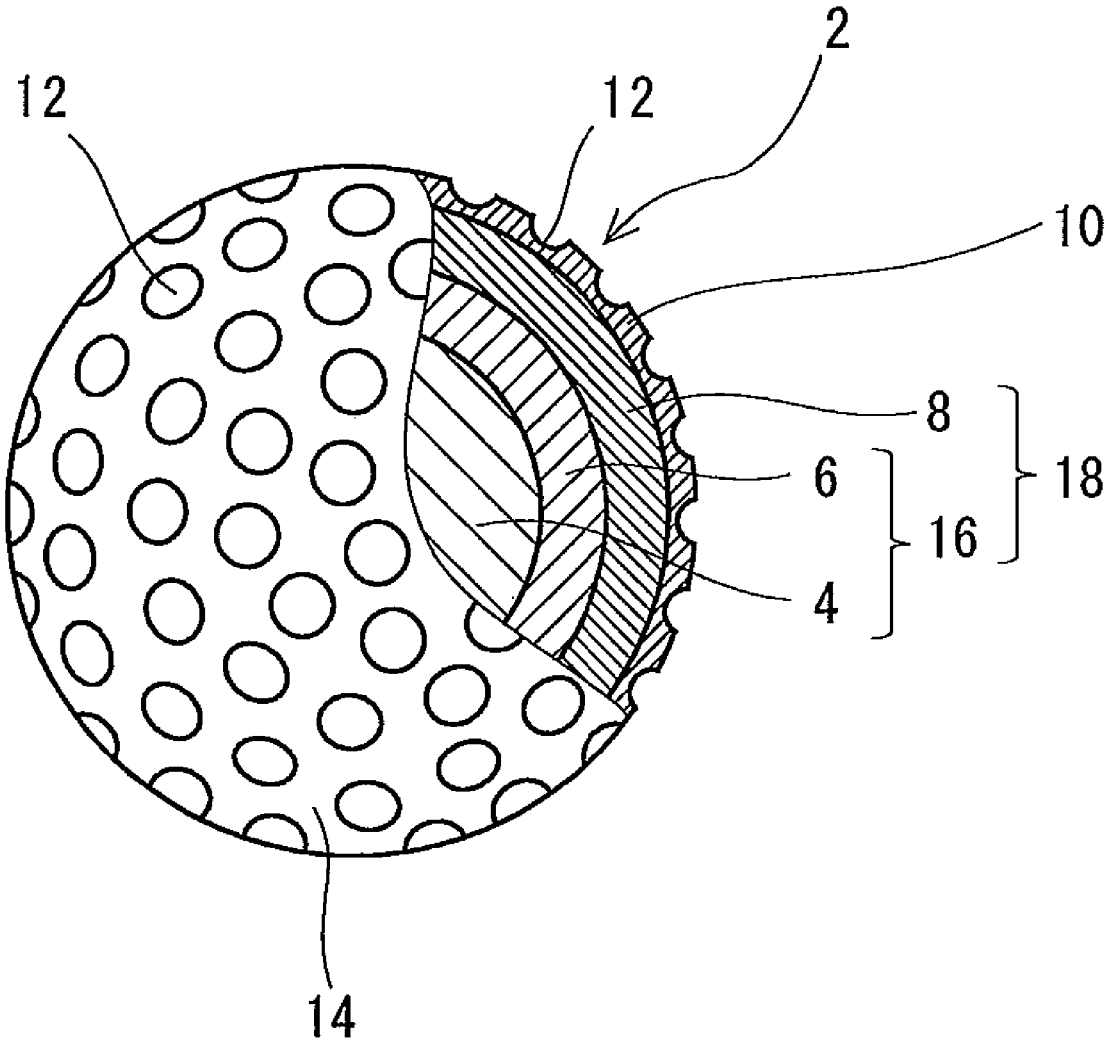
2
12
12
10
8
6
18
16
4
14

GOLF BALL

This application claims priority on Patent Application No. 2008-105217 filed in JAPAN on Apr. 15, 2008. The entire contents of this Japanese Patent Application are hereby incorporated by reference.

BACKGROUND OF THE INVENTION

1. Field of the Invention

The present invention relates to golf balls. Specifically, the present invention relates to multi-piece golf balls including a core, an envelope layer, a mid layer and a cover.

2. Description of the Related Art

The greatest interest to golf players concerning golf balls is flight performance. In particular, golf players place importance on a flight distance upon a shot with a driver. By using a golf ball which has a long flight distance upon a shot with a driver, golf players can hit a second shot at a point close to the green. A flight distance upon a shot with a driver correlates with a spin rate. A golf ball with a low spin rate has excellent flight performance. In addition, flight performance correlates with the resilience performance of a golf ball.

Golf players also place importance on spin performance of golf balls. If a backspin rate is high, the run is short. By using a golf ball which has a high backspin rate, golf players can let the golf ball to stop at a target point. If a sidespin rate is high, the golf ball tends to curve. By using a golf ball which has a high sidespin rate, golf players can intentionally let the golf ball to curve. A golf ball with excellent spin performance has excellent controllability. In particular, high-level golf players place importance on controllability of a shot with a short iron.

Golf players also place importance on feel at impact of golf balls. Golf players prefer soft feel at impact.

Golf balls with a cover including polyurethane are commercially available. In general, polyurethane is flexible. Spin is easily given to this golf ball. This cover contributes to the controllability. On the other hand, if this golf ball is hit with a driver, this cover causes excessive spin. This cover impairs the flight performance.

There are various proposals for achieving both flight performance and controllability. JP8-336617 discloses a golf ball with a two-layered core and a two-layered cover. JP2002-191719 (US2002/119,840) discloses a golf ball with a core and a three-layered cover. JP2004-130072 (US2004/029,648) discloses a golf ball with a three-layered core and a cover. JP2004-180822 (US2005/075,196) discloses a golf ball with a core, an inner mid layer, an outer mid layer and a cover. JP2006-326301 (US2006/270,492 and US2007/111823) discloses a golf ball with a core, an envelope layer, a mid layer and a cover.

The golf ball disclosed in JP8-336617 has a flexible inner cover and a hard outer cover. This golf ball has an insufficient spin upon a shot with a short iron. In addition, this golf ball has an insufficient flight distance upon a shot with a driver.

The outer cover of the golf ball disclosed in JP2002-191719 is hard. This golf ball has an insufficient spin upon a shot with a short iron.

The core of the golf ball disclosed in JP2004-130072 includes a center, a mid layer and an outer layer. The mid layer has a hardness less than that of the outer layer. This golf ball has insufficiently soft feel at impact.

The cover of the golf ball disclosed in JP2004-180822 is hard. This golf ball has an insufficient spin upon a shot with a short iron.

In the golf ball disclosed in JP2006-326301, the envelope layer has a hardness less than that of the mid layer. This golf ball has insufficiently soft feel at impact.

Golf players' requirements for golf balls have been escalated more than ever. An objective of the present invention is to provide a golf ball having excellent flight performance, excellent controllability and excellent feel at impact.

SUMMARY OF THE INVENTION

A golf ball according to the present invention comprises a core, an envelope layer positioned outside the core, a mid layer positioned outside the envelope layer and a cover positioned outside the mid layer. A thickness Tm of the mid layer is less than 1.2 mm. A thickness Tc of the cover is less than 0.6 mm. The sum of the thickness Tm and the thickness Tc is equal to or less than 1.7 mm. A hardness Hc of the cover is less than 40. The hardness Hs of the envelope layer, the hardness Hm of the mid layer, and the hardness Hc of the cover satisfy the following formula (1).

$$Hs \geqq Hm \geqq Hc \quad (1)$$

The hardness Hs, the hardness Hm, and the hardness Hc are measured with a Shore D type spring hardness scale.

When the golf ball is hit with a short iron, the cover deforms significantly. Because the cover is flexible, the spin rate is high when the golf ball is hit with a short iron. The cover achieves excellent controllability. When the golfball is hit with a driver, the envelope layer and the core significantly deform together with the cover and the mid layer. Because the envelope layer is hard, the spin rate is low when the golf ball is hit with a driver. The hard envelope layer also contributes to the resilience performance of the golf ball. The golf ball has excellent flight performance upon a shot with a driver. Because the golf ball satisfies the above formula (1), the hardness transition from the cover to the envelope layer is gradual. The gradual hardness transition achieves soft feel at impact. The golf ball has excellent flight performance, excellent controllability and excellent feel at impact.

Preferably, the golf ball satisfies the following formula (2).

$$Hs \geqq Hm \geqq Hc \quad (2)$$

Preferably, the base material of the cover is polyurethane. Preferably, the base material of the mid layer is one or more types selected from a group consisting of polyurethane, polyester, polyamide, polyolefin, polystyrene and ionomer resin. Polyurethane is particularly preferred. Preferably, the base material of the envelope layer is ionomer resin.

Preferably, the hardness Hs of the envelope layer is equal to or greater than 50. Preferably, the hardness Hm of the mid layer is equal to or greater than 30 and equal to or less than 60.

Preferably, the core has a diameter of 35.0 mm or greater and 42.0 mm or less.

BRIEF DESCRIPTION OF THE DRAWINGS

FIG. 1 is a schematic cross-sectional view of a golf ball according to an embodiment of the present invention.

DESCRIPTION OF THE PREFERRED EMBODIMENTS

The following will describe in detail the present invention based on preferred embodiments with reference to the accompanying drawing.

Golf ball 2 shown in FIG. 1 includes a spherical core 4, an envelope layer 6 positioned outside the core 4, a mid layer 8 positioned outside the envelope layer 6, and a cover 10 positioned outside the mid layer 8. On the surface of the cover 10, a large number of dimples 12 are formed. Of the surface of the golf ball 2, a part other than the dimples 12 is a land 14. The golf ball 2 includes a paint layer and a mark layer on the external side of the cover 10 although these layers are not shown in the drawing.

The golf ball 2 has a diameter of 40 mm or greater and 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and more preferably equal to or less than 42.80 mm. The golf ball 2 has a weight of 40 g or greater and 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

The core 4 is obtained by crosslinking a rubber composition. Examples of preferable base rubbers for use in the rubber composition include polybutadienes, polyisoprenes, styrene-butadiene copolymers, ethylene-propylene-diene copolymers and natural rubbers. In light of resilience performance, polybutadienes are preferred. When other rubber is used in combination with polybutadiene, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40 mol % and more preferably equal to or greater than 80 mol %.

In order to crosslink the core 4, a co-crosslinking agent is preferably used. Examples of preferable co-crosslinking agents in light of resilience performance include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

As a co-crosslinking agent, an α,β-unsaturated carboxylic acid having 2 to 8 carbon atoms, and a metal oxide, may be also included. Both components react in the rubber composition and form a salt. This salt contributes to the crosslinking reaction. Examples of preferable α,β-unsaturated carboxylic acids include acrylic acid and methacrylic acid. Examples of preferable metal oxides include zinc oxide and magnesium oxide.

In light of resilience performance of the golf ball 2, the amount of the co-crosslinking agent is preferably equal to or greater than 10 parts by weight and more preferably equal to or greater than 15 parts by weight, per 100 parts by weight of the base rubber. In light of soft feel at impact, the amount of the co-crosslinking agent is preferably equal to or less than 50 parts by weight and more preferably equal to or less than 45 parts by weight, per 100 parts by weight of the base rubber.

Preferably, the rubber composition of the core 4 includes an organic peroxide together with a co-crosslinking agent. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane and di-t-butyl peroxide. In light of versatility, dicumyl peroxide is preferred.

In light of resilience performance of the golf ball 2, the amount of the organic peroxide is preferably equal to or greater than 0.1 part by weight, more preferably equal to or greater than 0.3 part by weight, and particularly preferably equal to or greater than 0.5 part by weight, per 100 parts by weight of the base rubber. In light of soft feel at impact, the amount of the organic peroxide is preferably equal to or less than 3.0 parts by weight, more preferably equal to or less than 2.8 parts by weight, and particularly preferably equal to or less than 2.5 parts by weight, per 100 parts by weight of the base rubber.

Preferably, the rubber composition of the core 4 includes an organic sulfur compound. Examples of preferable organic sulfur compounds include monosubstitutions such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; disubstitutions such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide and bis(2-cyano-5-bromophenyl)disulfide; trisubstitutions such as bis(2,4,6-trichlorophenyl)disulfide and bis(2-cyano-4-chloro-6-bromophenyl)disulfide; tetrasubstitutions such as bis(2,3,5,6-tetrachlorophenyl)disulfide; and pentasubstitutions such as bis(2,3,4,5,6-pentachlorophenyl)disulfide and bis(2,3,4,5,6-pentabromophenyl)disulfide. The organic sulfur compound contributes to the resilience performance of the golf ball 2. Particularly preferable organic sulfur compounds are diphenyl disulfide and bis(pentabromophenyl)disulfide.

In light of resilience performance of the golf ball 2, the amount of the organic sulfur compound is preferably equal to or greater than 0.1 part by weight and more preferably equal to or greater than 0.2 part by weight, per 100 parts by weight of the base rubber. In light of soft feel at impact, the amount of the organic sulfur compound is preferably equal to or less than 1.5 parts by weight, more preferably equal to or less than 1.0 part by weight, and particularly preferably equal to or less than 0.8 part by weight, per 100 parts by weight of the base rubber.

For the purpose of adjusting specific gravity and the like, a filler may be included in the core 4. Examples of suitable fillers include zinc oxide, barium sulfate, calcium carbonate and magnesium carbonate. Powder of a metal with a high specific gravity may be included as a filler. Specific examples of metals with a high specific gravity include tungsten and molybdenum. The amount of the filler is determined as appropriate so that the intended specific gravity of the core 4 is accomplished. A particularly preferable filler is zinc oxide. Zinc oxide serves not only as a specific gravity adjuster but also as a crosslinking activator. According to need, various additives such as sulfur, an anti-aging agent, a coloring agent, a plasticizer, a dispersant and the like may be included in the core 4 at an adequate amount. Crosslinked rubber powder or synthetic resin powder may be also included in the core 4.

In light of resilience performance, the core 4 has a central hardness H1 of preferably 35 or greater, more preferably 40 or greater, and particularly preferably 45 or greater. In light of suppression of spin upon a shot with a driver, the central hardness H1 is preferably equal to or less than 80, more preferably equal to or less than 75, and particularly preferably equal to or less than 70. The central hardness H1 is measured by pressing a JIS-C type hardness scale against the central point of a cut plane of the core 4 which has been cut into two halves. For the measurement, an automated rubber hardness measurement machine (trade name "P1", available from Kobunshi Keiki Co., Ltd.), to which this hardness scale is mounted, is used.

In light of resilience performance, the core 4 has a surface hardness H2 of preferably 45 or greater, more preferably 50 or greater, and particularly preferably 55 or greater. In light of feel at impact, the surface hardness H2 is preferably equal to or less than 100, more preferably equal to or less than 95, and particularly preferably equal to or less than 90. The surface hardness H2 is measured by pressing a JIS-C type hardness scale against the surface of the core 4. For the measurement, an automated rubber hardness measurement machine (trade name "P1", available from Kobunshi Keiki Co., Ltd.), to which this hardness scale is mounted, is used.

In light of feel at impact, the difference (H2−H1) between the surface hardness H2 and the central hardness H1 is preferably equal to or greater than 5, more preferably equal to or greater than 8, and particularly preferably equal to or greater than 12. In light of resilience performance, the difference (H2−H1) is preferably equal to or less than 35, more preferably equal to or less than 32, and particularly preferably equal to or less than 30.

In light of feel at impact, the core 4 has an amount of compressive deformation D1 of preferably 2.3 mm or greater, more preferably 2.4 mm or greater, and particularly preferably 2.5 mm or greater. In light of resilience performance, the amount of compressive deformation D1 is preferably equal to or less than 6.0 mm, more preferably equal to or less than 5.5 mm, and particularly preferably equal to or less than 4.0 mm.

Upon measurement of the amount of compressive deformation, a spherical body (the core 4, the golf ball 2, and the like) is placed on a hard plate made of metal. A cylinder made of metal gradually descends toward the spherical body. The spherical body, squeezed between the bottom face of the cylinder and the hard plate, becomes deformed. A migration distance of the cylinder, starting from the state in which an initial load of 98 N is applied to the spherical body up to the state in which a final load of 1274 N is applied thereto, is the amount of compressive deformation.

In light of resilience performance, the core 4 has a diameter of preferably 35.0 mm or greater, more preferably 36.0 mm or greater, and particularly preferably 37.0 mm or greater. In light of forming the envelope layer 6 with a sufficient thickness, the diameter is preferably equal to or less than 42.0 mm, more preferably equal to or less than 41.6 mm, and particularly preferably equal to or less than 41.2 mm.

The core 4 has a weight of preferably 25 g or greater and 42 g or less. The temperature for crosslinking the core 4 is generally equal to or higher than 140° C. and equal to or lower than 180° C. The time period for crosslinking the core 4 is generally equal to or longer than 10 minutes and equal to or shorter than 60 minutes. The core 4 may be formed with two or more layers. The core 4 may have a rib on the surface thereof.

A resin composition is preferably used for the envelope layer 6. Examples of the base polymer of this resin composition include ionomer resins, polyesters, polyamides, polyolefins and polystyrenes. Particularly, ionomer resins are preferred. Ionomer resins are highly elastic. As described later, the mid layer 8 and the cover 10 of the golf ball 2 are thin. When the golf ball 2 is hit with a driver, the envelope layer 6 significantly deforms due to the thinness of the mid layer 8 and the cover 10. The envelope layer 6 including an ionomer resin contributes to the resilience performance upon a shot with a driver.

An ionomer resin and another resin may be used in combination. In this case, in light of resilience performance, the ionomer resin is included as a principal component of the base polymer. The proportion of the ionomer resin to the entire base polymer is preferably equal to or greater than 50% by weight, more preferably equal to or greater than 70% by weight, and particularly preferably equal to or greater than 85% by weight.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. This binary copolymer provides excellent resilience performance to the golf ball 2. Examples of other preferable ionomer resins include ternary copolymers formed with an α-olefin, an α,β-unsaturated carboxylic acid having 3 to 8 carbon atoms, and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. This ternary copolymer provides excellent resilience performance to the golf ball 2. For the binary copolymer and ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and ternary copolymer, a part of the carboxyl group is neutralized with a metal ion. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion and magnesium ion.

Specific examples of ionomer resins include trade names "Himilan 1555", "Himilan 1557", "Himilan 1605", "Himilan 1706", "Himilan 1707", "Himilan 1856", "Himilan 1855", "HimilanAM7311", "Himilan AM7315", "Himilan AM7317", "Himilan AM7318", "Himilan AM7329", "Himilan MK7320" and "Himilan MK7329", available from Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945" and "Surlyn AD 8546", available from E.I. du Pont de Nemours and Company; and trade names "IOTEK 7010", "IOTEK 7030", "IOTEK 7510", "IOTEK 7520", "IOTEK 8000" and "IOTEK 8030", available from ExxonMobil Chemical Corporation. Two or more types of ionomer resins may be used in combination. An ionomer resin neutralized with a monovalent metal ion and an ionomer resin neutralized with a bivalent metal ion may be used in combination.

As described later, the envelope layer 6 is hard. By using an ionomer resin having a high acid content, it is achieved that the envelope layer 6 is hard. The acid content is preferably equal to or greater than 10% by weight and equal to or less than 30% by weight. Specific examples of ionomer resins having a high acid content include the aforementioned "Himilan 1605", "Himilan 1706", "Himilan 1707", "Himilan AM7311", "Himilan AM7317", "Himilan AM7318", "Himilan AM7329", "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD 8546", "IOTEK 8000" and "IOTEK 8030".

For the purpose of adjusting specific gravity, a filler may be included in the resin composition of the envelope layer 6. Examples of fillers to be used include zinc oxide, barium sulfate, calcium carbonate and magnesium carbonate. Powder of a metal with a high specific gravity may be included as a filler. Specific examples of metals with a high specific gravity include tungsten and molybdenum. The amount of the filler is determined as appropriate so that the intended specific gravity of the envelope layer 6 is accomplished. A coloring agent may be included in the envelope layer 6. A crosslinked rubber powder or synthetic resin powder may be also included in the envelope layer 6.

A preferable filler is zinc oxide. As described later, the envelope layer 6 is hard. By using zinc oxide, it is achieved that the envelope layer 6 is hard. In light of hardness, the amount of zinc oxide per 100 parts by weight of the base resin is preferably equal to or greater than 2 parts by weight and particularly preferably equal to or greater than 5 parts by weight. The amount of zinc oxide is preferably equal to or less than 20 parts by weight. Zinc oxide in the form of needle crystal having a three-dimensional shape is particularly preferred. A specific example of zinc oxide in the form of needle crystal is trade name "Pana-Tetra" available from Panasonic Corporation.

The envelope layer 6 is hard. The golf ball 2 with the hard envelope layer 6 has excellent resilience performance upon a shot with a driver. A spherical body 16 including the hard envelope layer 6 and the core 4 can achieve an outer-hard/inner-soft hardness distribution. When the golf ball 2 having this hardness distribution is hit with a driver, the spin is suppressed. The synergistic effect of the resilience performance and the spin suppression achieves excellent flight performance of the golf ball 2. The golf ball 2 having this hardness distribution also has excellent feel at impact. In light of flight performance and feel at impact, the envelope layer 6 has a hardness Hs of preferably 50 or greater, more preferably 58 or greater, and particularly preferably 62 or greater. In light of feel at impact and durability, the hardness Hs is preferably equal to or less than 85, more preferably equal to or less than 80, and particularly preferably equal to or less than 75.

In the present invention, the hardness Hs of the envelope layer 6 is measured according to the standards of "ASTM-D2240-68". For the measurement, an automated rubber hardness measurement machine (trade name "P1", available from Kobunshi Keiki Co., Ltd.), to which a Shore D type spring hardness scale is mounted, is used. For the measurement, a sheet, which is formed by hot press, is made of the same material as the envelope layer 6, and has a thickness of about 2 mm, is used. Prior to the measurement, the sheet is maintained at 23° C. for two weeks. At the measurement, three sheets are stacked.

In light of flight performance, the envelope layer 6 has a thickness Ts of preferably 0.5 mm or greater, more preferably 0.7 mm or greater, and particularly preferably 0.9 mm or greater. In light of feel at impact, the thickness Ts is preferably equal to or less than 2.4 mm, more preferably equal to or less than 2.1 mm, and particularly preferably equal to or less than 1.7 mm.

For forming the envelope layer 6, a known method such as injection molding and compression molding can be used. In light of productivity, injection molding is preferred.

In light of feel at impact, the spherical body 16 including the core 4 and the envelope layer 6 has an amount of compressive deformation Ds of preferably 2.0 mm or greater, more preferably 2.1 mm or greater, and particularly preferably 2.2 mm or greater. In light of resilience performance, the amount of compressive deformation Ds is preferably equal to or less than 3.8 mm, more preferably equal to or less than 3.7 mm, and particularly preferably equal to or less than 3.6 mm.

The mid layer 8 is made of a resin composition. Examples of the base polymer of this resin composition include polyurethanes, polyesters, polyamides, polyolefins, polystyrenes and ionomer resins. Polyurethanes are particularly preferred. Polyurethanes are flexible. As described later, the cover 10 of the golf ball 2 is thin. Thus, when the golf ball 2 is hit with a short iron, the mid layer 8 significantly deforms together with the cover 10. When the golf ball 2 with the mid layer 8 including polyurethane is hit with a short iron, the spin rate is high. The mid layer 8 made of polyurethane contributes to the controllability of a shot with a short iron.

For the mid layer 8, polyurethane and other resin may be used in combination. In this case, in light of spin performance, the polyurethane is a principal component of the base polymer. The proportion of the amount of the polyurethane to the entire base polymer is preferably equal to or greater than 50% by weight, more preferably equal to or greater than 70% by weight, and particularly preferably equal to or greater than 85% by weight.

For the mid layer 8, thermoplastic polyurethanes and thermosetting polyurethanes can be used. In light of productivity, thermoplastic polyurethanes are preferred. A thermoplastic polyurethane includes a polyurethane component as a hard segment, and a polyester component or a polyether component as a soft segment. Examples of the curing agent for the polyurethane component include alicyclic diisocyanates, aromatic diisocyanates and aliphatic diisocyanates. Alicyclic diisocyanates are particularly preferred. Because an alicyclic diisocyanate does not have any double bond in the main chain, the alicyclic diisocyanate suppresses yellowing of the mid layer 8. Two or more types of diisocyanates may be used in combination.

Examples of alicyclic diisocyanates include 4,4'-dicyclohexylmethane diisocyanate ($H_{12}MDI$), 1,3-bis(isocyanatemethyl)cyclohexane ($H_6XDI$), isophorone diisocyanate (IPDI) and trans-1,4-cyclohexane diisocyanate (CHDI). In light of versatility and processability, $H_{12}MDI$ is preferred.

Examples of aromatic diisocyanates include 4,4'-diphenylmethane diisocyanate (MDI) and toluene diisocyanate (TDI). One example of aliphatic diisocyanates is hexamethylene diisocyanate (HDI).

Specific examples of thermoplastic polyurethanes include trade names "Elastollan XNY80A", "Elastollan XNY85A", "Elastollan XNY90A", "Elastollan XNY97A", "Elastollan XNY585" and"Elastollan XKP016N", available from BASF Japan Ltd.; and trade names "RESAMINE P4585LS" and "RESAMINE PS62490", available from Dainichiseika Color & Chemicals Mfg. Co., Ltd.

The mid layer 8 may be formed of a composition including thermoplastic polyurethane and an isocyanate compound. During or after forming the mid layer 8, the polyurethane is crosslinked with the isocyanate compound.

According to need, a coloring agent such as titanium dioxide, a filler such as barium sulfate, a dispersant, an antioxidant, an ultraviolet absorber, a light stabilizer, a fluorescent material, a fluorescent brightener and the like are included in the mid layer 8 at an adequate amount. For the purpose of adjusting specific gravity, powder of a metal with a high specific gravity such as tungsten, molybdenum and the like may be included in the mid layer 8.

In light of resilience performance, the mid layer 8 has a hardness Hm of preferably 30 or greater, more preferably 36 or greater, and particularly preferably 42 or greater. In light of controllability, the hardness Hm is preferably equal to or less than 60, more preferably equal to or less than 57, and particularly preferably equal to or less than 54. The hardness Hm of the mid layer 8 is measured by the same method as that for the hardness Hs of the envelope layer 6.

In light of controllability, the mid layer 8 has a thickness Tm of preferably 0.1 mm or greater, more preferably 0.2 mm or greater, and particularly preferably 0.3 mm or greater. In light of resilience performance, the thickness Tm is preferably equal to or less than 1.2 mm, more preferably equal to or less than 1.0 mm, and particularly preferably equal to or less than 0.8 mm.

For forming the mid layer 8, known methods such as injection molding, compression molding, cast molding and the like can be used. The mid layer 8 may be formed by applying the solution or dispersion liquid of the resin composition to the surface of the envelope layer 6.

In light of feel at impact, a spherical body 18 including the core 4, the envelope layer 6 and the mid layer 8 has an amount of compressive deformation Dm of preferably 1.8 mm or greater, more preferably 2.0 mm or greater, and particularly preferably 2.2 mm or greater. In light of resilience performance, the amount of compressive deformation Dm is preferably equal to or less than 3.8 mm, more preferably equal to or less than 3.6 mm, and particularly preferably equal to or less than 3.4 mm.

The cover 10 is made of a resin composition. Examples of the base polymer of this resin composition include polyurethanes, polyesters, polyamides, polyolefins, polystyrenes and ionomer resins. Polyurethanes are particularly preferred. Polyurethanes are flexible. When the golf ball 2 with the cover 10 including polyurethane is hit with a short iron, the spin rate is high. The cover 10 made of polyurethane contributes to the controllability of a shot with a short iron.

For the cover 10, polyurethane and other resin may be used in combination. In this case, in light of spin performance, the polyurethane is a principal component of the base polymer. The proportion of the amount of the polyurethane to the entire base polymer is preferably equal to or greater than 50% by weight, more preferably equal to or greater than 70% by weight, and particularly preferably equal to or greater than 85% by weight.

For the cover 10, thermoplastic polyurethanes and thermosetting polyurethanes can be used. In light of productivity, thermoplastic polyurethanes are preferred. The thermoplastic polyurethanes exemplified for the mid layer 8 can be used for the cover 10. In light of scuff resistance of the cover 10, thermoplastic polyurethanes each including a polyurethane component for which $H_{12}$MDI is used as the curing agent are preferred. The cover 10 may be formed of a composition including thermoplastic polyurethane and an isocyanate compound. During or after forming the cover 10, the polyurethane is crosslinked with the isocyanate compound.

According to need, a coloring agent such as titanium dioxide, a filler such as barium sulfate, a dispersant, an antioxidant, an ultraviolet absorber, a light stabilizer, a fluorescent material, a fluorescent brightener and the like are included in the cover 10 at an adequate amount.

In light of resilience performance, the cover 10 has a hardness Hc of preferably 16 or greater, more preferably 20 or greater, and particularly preferably 24 or greater. In light of controllability, the hardness Hc is preferably equal to or less than 40, more preferably equal to or less than 38, and particularly preferably equal to or less than 36. The hardness Hc of the cover 10 is measured by the same method as that for the hardness Hs of the envelope layer 6.

The cover 10 has a thickness Tc of preferably 0.6 mm or less. As described above, the cover 10 is flexible. The flexible cover 10 is disadvantageous to the resilience coefficient of the golf ball 2. Upon a shot with a driver, the core 4 and the envelope layer 6 also significantly deforms. By setting the thickness Tc to be equal to or less than 0.6 mm, even if the cover 10 is flexible, the cover 10 does not have a significantly adverse effect on the resilience coefficient upon a shot with a driver. The cover 10 with a thickness Tc of 0.6 mm or less does not impair the flight performance of the golf ball 2. In light of flight performance, the thickness Tc is preferably equal to or less than 0.5 mm and particularly preferably equal to or less than 0.4 mm In light of ease of forming the cover 10, the thickness Tc is preferably equal to or greater than 0.1 mm and more preferably equal to or greater than 0.2 mm.

For forming the cover 10, known methods such as injection molding, compression molding, cast molding and the like can be used. When forming the cover 10, the dimples 12 are formed by a large number of pimples formed on the cavity face of a mold. The cover 10 may be formed by applying the solution or dispersion liquid of the resin composition to the surface of the mid layer 8. A sphere with the cover 10 having a smooth surface by the application may be formed, and placed into a mold to form the dimples 12 thereon.

In light of feel at impact, the golf ball 2 has an amount of compressive deformation Db of preferably 1.8 mm or greater, more preferably 1.9 mm or greater, and particularly preferably 2.0 mm or greater. In light of resilience performance, the amount of compressive deformation Db is preferably equal to or less than 3.8 mm, more preferably equal to or less than 3.7 mm, and particularly preferably equal to or less than 3.6 mm.

The golf ball 2 may include a reinforcing layer between the envelope layer 6 and the mid layer 8. The reinforcing layer firmly adheres to the envelope layer 6 and also to the mid layer 8. The reinforcing layer prevents separation of the mid layer 8 from the envelope layer 6. As described above, the mid layer 8 and the cover 10 of the golf ball 2 are thin. When the golf ball 2 is hit by the edge of a clubface, a wrinkle is likely to occur. However, the reinforcing layer prevents a wrinkle from occurring.

As the base polymer of the reinforcing layer, a two-component curing type thermosetting resin is suitably used. Examples of two-component curing type thermosetting resins include epoxy resins, urethane resins, acrylic resins, polyester resins and cellulose resins. In light of strength and durability of the reinforcing layer, two-component curing type epoxy resins and two-component curing type urethane resins are preferred.

The reinforcing layer may include additives such as a coloring agent (typically, titanium dioxide), a phosphate-based stabilizer, an antioxidant, a light stabilizer, a fluorescent brightener, an ultraviolet absorber, an anti-blocking agent and the like. The additives may be added to the base material of the two-component curing thermosetting resin, or may be added to the curing agent of the two-component curing thermosetting resin.

The reinforcing layer is obtained by applying, to the surface of the envelope layer 6, a liquid which is prepared by dissolving or dispersing the base material and the curing agent in a solvent. In light of workability, application with a spray gun is preferred. After the application, the solvent is volatilized to permit a reaction of the base material with the curing agent, thereby forming the reinforcing layer.

In light of prevention of a wrinkle, the reinforcing layer has a thickness of preferably 3 μm or greater and more preferably 5 μm or greater. In light of ease of forming the reinforcing layer, the thickness is preferably equal to or less than 300 μm, more preferably equal to or less than 50 μm, and particularly preferably equal to or less than 20 μm. The thickness is measured by observing a cross section of the golf ball 2 with a microscope. When the envelope layer 6 has concavities and convexities on its surface from surface roughening, the thickness of the reinforcing layer is measured at a convex part.

In light of prevention of a wrinkle, the reinforcing layer has a pencil hardness of preferably 4B or harder and more preferably B or harder. In light of reduced loss of the power transmission from the mid layer 8 to the envelope layer 6 upon a hit of the golf ball 2, the reinforcing layer has a pencil hardness of preferably 3H or softer. The pencil hardness is measured according to the standards of "JIS K5400".

In the golf ball 2 according to the present invention, the hardness Hs of the envelope layer 6, the hardness Hm of the mid layer 8, and the hardness Hc of the cover 10 satisfy the following formula (1).

$$Hs \geqq Hm \geqq Hc \quad (1)$$

In the golf ball 2, the hardness transition from the cover 10 to the envelope layer 6 is gradual. The gradual hardness transition does not impair the feel at impact of the golf ball 2.

Preferably, the hardness Hs of the envelope layer 6, the hardness Hm of the mid layer 8, and the hardness Hc of the cover 10 satisfy the following formula (2).

$$Hs \geqq Hm \geqq Hc \quad (2)$$

In the golf ball 2, the envelope layer 6 having the great hardness Hs is used in light of resilience performance. In the golf ball 2, the cover 10 having the small hardness Hc is used in light of controllability. By providing the mid layer 8, which has the hardness Hm less than the hardness Hs and greater than the hardness Hc, between the envelope layer 6 and the cover 10, the hardness gradually increases from the cover 10 through the mid layer 8 to the envelope layer 6. This hardness transition achieves soft feel at impact of the golf ball 2. The golf ball 2 which satisfies the above formula (2) has excellent feel at impact, excellent flight performance upon a shot with a driver, and excellent controllability upon a shot with a short iron.

In light of feel at impact, flight performance, and controllability, the difference (Hs−Hm) between the hardness Hs and the hardness Hm is preferably equal to or greater than 5 and equal to or less than 40, more preferably equal to or greater than 10 and equal to or less than 35, and particularly preferably equal to or greater than 10 and equal to or less than 29.

In light of feel at impact, flight performance, and controllability, the difference (Hm−Hc) between the hardness Hm and the hardness Hc is preferably equal to or greater than 3 and equal to or less than 30, more preferably equal to or greater than 5 and equal to or less than 25, and particularly preferably equal to or greater than 9 and equal to or less than 21.

In light of feel at impact, flight performance, and controllability, the difference (Hs−Hc) between the hardness Hs and the hardness Hc is preferably equal to or greater than 10 and equal to or less than 60, more preferably equal to or greater than 15 and equal to or less than 50, and particularly preferably equal to or greater than 19 and equal to or less than 41.

In light of controllability, the sum (Tm+Tc) of the thickness Tm of the mid layer 8 and the thickness Tc of the cover 10 is preferably equal to or less than 1.7 mm, more preferably equal to or less than 1.2 mm, and particularly preferably equal to or less than 0.9 mm. In light of ease of producing the mid layer 8 and the cover 10, the sum (Tm+Tc) is preferably equal to or greater than 0.2 mm and more preferably equal to or greater than 0.3 mm.

EXAMPLES

Example 1

A rubber composition (b) was obtained by kneading 100 parts by weight of high-cis polybutadiene (trade name "BR-730", available from JSR Corporation), 34 parts by weight of zinc diacrylate, 5 parts by weight of zinc oxide, an appropriate amount of barium sulfate, 0.5 part by weight of diphenyl disulfide, and 0.8 part by weight of dicumyl peroxide (available from NOF Corporation). This rubber composition (b) was placed into a mold including upper and lower mold halves each having a hemispherical cavity, and heated at 170° C. for 30 minutes to obtain a core with a diameter of 39.5 mm.

A resin composition (f) was obtained by kneading 50 parts by weight of an ionomer resin ("Himilan 1605", available from Du Pont-MITSUI POLYCHEMICALS Co., Ltd.), 50 parts by weight of another ionomer resin ("Himilan AM7329", available from Du Pont-MITSUI POLYCHEMICALS Co., Ltd.), 10 parts by weight of zinc oxide (trade name "Pana-Tetra WZ-0501", available from Panasonic Corporation), and 4 parts by weight of titanium dioxide with a twin-screw kneading extruder. The core was covered with this resin composition (f) by injection molding to form an envelope layer with a thickness of 1.2 mm.

A paint composition (trade name "POLIN 750LE", available from SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of modified polyamide amine, 55 parts by weight of a solvent, and 5 parts by weight of titanium oxide. The weight ratio of the base material liquid to the curing agent liquid is 1/1. This paint composition was applied to the surface of the envelope layer with a spray gun, and maintained at 23° C. for 6 hours to obtain a reinforcing layer with a thickness of 10 μm.

A resin composition (d) was obtained by kneading 100 parts by weight of a thermoplastic polyurethane elastomer (the aforementioned "Elastollan XNY90A") and 4 parts by weight of titanium dioxide with a twin-screw kneading extruder. Two half shells were obtained from this resin composition (d) by compression molding. The spherical body including the core, the envelope layer, and the reinforcing layer was covered with this two half shells. The half shells and the spherical body were placed into a mold including upper and lower mold halves each having a hemispherical cavity, and compression molding was performed to obtain amid layer with a thickness of 0.2 mm.

A resin composition (e) was obtained by kneading 100 parts by weight of a thermoplastic polyurethane elastomer (the aforementioned "Elastollan XNY80A") and 4 parts by weight of titanium dioxide with a twin-screw kneading extruder. Two half shells were obtained from this resin composition (e) by compression molding. The spherical body including the core, the envelope layer, the reinforcing layer, and the mid layer was covered with this two half shells. The half shells and the spherical body were placed into a final mold which includes upper and lower mold halves each having a hemispherical cavity and which has a large number of pimples on its cavity face, and compression molding was performed to obtain a cover with a thickness of 0.2 mm. A large number of dimples having a shape inverted from the shape of the pimples were formed on the cover. A clear paint including a two-component curing type polyurethane as a base was applied to this cover to obtain a golf ball of Example 1 with a diameter of 42.7 mm and a weight of 45.4 g.

Examples 2 to 4 and Comparative Examples 1 to 6

Golf balls of Examples 2 to 4 and Comparative Examples 1 to 6 were obtained in a similar manner as Example 1, except the specifications of the core, the envelope layer, the mid layer, and the cover were as shown in the following Tables 3 and 4. The rubber composition of the core is shown in detail in the following Table 1. The resin compositions of the envelope layer, the mid layer, and the cover are shown in detail in the following Table 2. The golf ball of Comparative Example 1 does not have a mid layer.

[Shot with Driver]

A driver with a titanium head (trade name "SRIXON W505", available from SRI Sports Limited, shaft hardness: X, loft angle: 8.5°) was attached to a swing machine available from Golf Laboratories, Inc. A golf ball was hit under the condition of a head speed of 50 m/sec, and the distance from the launch point to the stop point was measured. In addition, the backspin rate immediately after the hit was measured. The average value of data obtained by 12 measurements is shown in the following tables 3 and 4.

[Shot with Short Iron]

A sand wedge (trade name "SRIXON I302", available from SRI Sports Limited) was attached to a swing machine available from True Temper Co. A golf ball was hit under the condition of a head speed of 21 m/sec, and the backspin rate was measured. The average value of data obtained by 12 measurements is shown in the following tables 3 and 4.

[Evaluation of Feel at Impact]

Ten golf players hit golf balls with drivers, and evaluated feel at impact of the golf balls. The evaluation was categorized as follows based on the number of golf players who said, "the feel at impact was excellent".

A: 8 or more

B: 4 to 7

C: less than 4

The results are shown in the following tables 3 and 4.

TABLE 1

Composition of Core (parts by weight)

| | (a) | (b) |
|---|---|---|
| Polybutadiene | 100 | 100 |
| Zinc diacrylate | 39 | 34 |
| Zinc oxide | 5 | 5 |
| Barium sulfate | Appropriate amount | Appropriate amount |
| Diphenyl disulfide | 0.5 | 0.5 |
| Dicumyl peroxide | 0.8 | 0.8 |

TABLE 2

Compositions of Envelope Layer, Mid Layer and Cover (parts by weight)

| | (c) | (d) | (e) | (f) | (g) |
|---|---|---|---|---|---|
| Elastollan XNY97A | 100 | — | — | — | — |
| Elastollan XNY90A | — | 100 | — | — | — |
| Elastollan XNY80A | — | — | 100 | — | — |
| Himilan 1605 | — | — | — | 50 | — |
| Himilan AM7329 | — | — | — | 50 | — |
| Himilan 1555 | — | — | — | — | 46 |
| Himilan 1557 | — | — | — | — | 46 |
| Rabalon T3221C *1 | — | — | — | — | 8 |
| Pana-Tetra WZ-0501 *2 | — | — | — | — | 2 |
| Pana-Tetra WZ-0511 *2 | — | — | — | 10 | — |
| Titanium dioxide | 4 | 4 | 4 | 4 | 4 |
| Hardness Shore D | 47 | 38 | 26 | 67 | 57 |

*1 styrene block-containing thermoplastic resin elastomer (available from Mitsubishi Chemical Corporation)

*2 zinc oxide having a three-dimensional shape (available from Panasonic Corporation)

TABLE 3

Results of Evaluation

| | | Example 1 | Example 2 | Example 3 | Example 4 | Compara. Example 1 |
|---|---|---|---|---|---|---|
| Core | Composition | (b) | (a) | (b) | (a) | (a) |
| | Diameter (mm) | 39.5 | 39.7 | 37.3 | 36.5 | 39.7 |
| | Compressive deformation D1 (mm) | 3.2 | 2.7 | 3.2 | 2.7 | 2.7 |
| | Surface hardness H2 (JIS-C) | 82 | 84 | 82 | 84 | 84 |
| Envelope layer | Composition | (f) | (f) | (g) | (f) | (f) |
| | Thickness Ts (mm) | 1.2 | 1.0 | 1.8 | 1.6 | 1.0 |
| | Hardness Hs (Shore D) | 67 | 67 | 57 | 67 | 67 |
| Mid layer | Composition | (d) | (c) | (c) | (g) | — |
| | Thickness Tm (mm) | 0.2 | 0.3 | 0.6 | 1.0 | — |
| | Hardness Hm (Shore D) | 38 | 47 | 47 | 57 | — |
| Cover | Composition | (e) | (e) | (d) | (d) | (e) |
| | Thickness Tc (mm) | 0.2 | 0.2 | 0.3 | 0.5 | 0.5 |
| | Hardness Hc (Shore D) | 26 | 26 | 38 | 38 | 26 |
| Golf ball | Compressive deformation Db (mm) | 2.7 | 2.3 | 2.9 | 2.1 | 2.3 |
| Tm + Tc (mm) | | 0.4 | 0.5 | 0.9 | 1.5 | 0.5 |
| Hs − Hm | | 29 | 20 | 10 | 10 | — |
| Hm − Hc | | 12 | 21 | 9 | 19 | — |
| Spin with driver (rpm) | | 2200 | 2300 | 2400 | 2250 | 2550 |
| Flight distance with driver (m) | | 274.5 | 276.0 | 274.0 | 272.5 | 272.0 |
| Spin with short iron (rpm) | | 7100 | 7000 | 6800 | 6900 | 7300 |
| Feel at impact | | A | A | A | A | C |

TABLE 4

| Results of Evaluation | | | | | | |
|---|---|---|---|---|---|---|
| | | Compara. Example 2 | Compara. Example 3 | Compara. Example 4 | Compara. Example 5 | Compara. Example 6 |
| Core | Composition | (b) | (a) | (b) | (a) | (b) |
| | Diameter (mm) | 37.5 | 35.3 | 36.5 | 36.1 | 39.5 |
| | Compressive deformation D1 (mm) | 3.2 | 2.7 | 3.2 | 3.2 | 3.2 |
| | Surface hardness H2 (JIS-C) | 82 | 84 | 82 | 84 | 82 |
| Envelope layer | Composition | (f) | (f) | (g) | (f) | (d) |
| | Thickness Ts (mm) | 1.3 | 2.1 | 1.6 | 1.4 | 1.2 |
| | Hardness Hs (Shore D) | 67 | 67 | 57 | 67 | 38 |
| Mid layer | Composition | (g) | (c) | (f) | (c) | (f) |
| | Thickness Tm (mm) | 0.8 | 0.8 | 1.2 | 1.3 | 0.2 |
| | Hardness Hm (Shore D) | 57 | 47 | 67 | 47 | 67 |
| Cover | Composition | (c) | (d) | (e) | (d) | (e) |
| | Thickness Tc (mm) | 0.5 | 0.8 | 0.3 | 0.6 | 0.2 |
| | Hardness Hc (Shore D) | 47 | 26 | 26 | 38 | 26 |
| Golf ball | Compressive deformation Db (mm) | 2.8 | 2.0 | 2.6 | 2.7 | 3.0 |
| Tm + Tc (mm) | | 1.3 | 1.6 | 1.5 | 1.9 | 0.4 |
| Hs − Hm | | 10 | 20 | −10 | 20 | −29 |
| Hm − Hc | | 10 | 21 | 41 | 9 | 41 |
| Spin with driver (rpm) | | 2100 | 2650 | 2450 | 2300 | 2550 |
| Flight distance with driver (m) | | 275.5 | 272.5 | 273.0 | 274.0 | 272.0 |
| Spin with short iron (rpm) | | 6300 | 6700 | 6900 | 6500 | 6800 |
| Feel at impact | | B | A | C | A | A |

As shown in Tables 3 and 4, the golf ball of each Example is excellent for all the evaluation items. From the results of evaluation, advantages of the present invention are clear.

The golf ball according to the present invention can be used for playing golf on a golf course and practicing at a driving range. The above description is merely for illustrative examples, and various modifications can be made without departing from the principles of the present invention.

What is claimed is:

1. A golf ball comprising a core, an envelope layer positioned outside the core, a mid layer positioned outside the envelope layer and a cover positioned outside the mid layer, wherein, a thickness Tm of the mid layer is less than 1.2 mm, a thickness Tc of the cover is less than 0.6 mm, the sum of the thickness Tm and the thickness Tc is equal to or less than 1.7 mm, a Shore D hardness Hc of the cover is less than 40, and the Shore D hardness Hs of the envelope layer, the Shore D hardness Hm of the mid layer, and the Shore D hardness He of the cover satisfy the following formula (2):

$$Hs>Hm>Hc \quad (2);$$

wherein the base material of the cover is polyurethane;

wherein the base material of the mid layer is polyurethane;

wherein the base material of the envelope layer is ionomer resin;

wherein a difference between the hardness Hs of the envelope layer and the hardness Hm of the mid layer is equal to or greater than 10 and equal to or less than 29;

wherein a difference between the hardness Hs of the envelope layer and the hardness Hc of the cover is equal to or greater than 19 and equal to or less than 41; and wherein a difference between the hardness Hm of the mid layer and the hardness Hc of the cover is equal to or greater than 9 and equal to or less than 21.

2. The golf ball according to claim 1, wherein the Shore D hardness Hs of the envelope layer is equal to or greater than 50.

3. The golf ball according to claim 1, wherein the Shore D hardness Hm of the mid layer is equal to or greater than 30 and equal to or less than 60.

4. The golf ball according to claim 1, wherein the core has a diameter of 35.0 mm or greater and 42.0 mm or less.

5. The golf ball according to claim 1, wherein a difference between a surface hardness H2 and a central hardness H1 of the core is equal to or greater than 5 and equal to or less than 35 according to measurements by a JIS-C type hardness scale.

6. The golf ball according to claim 5, wherein the difference between a surface hardness H2 and a central hardness H1 of the core is equal to or greater than 12 and equal to or less than 35 according to measurements by a JIS-C type hardness scale.

7. The golf ball according to claim 1, wherein the core has a diameter of 39.5 mm or greater and 41.2 mm or less.

8. The golf ball according to claim 1, wherein an amount of compressive deformation D1 of the core is equal to or greater than 2.3 mm and equal to or less than 6.0 mm;

an amount of compressive deformation Ds of a spherical body including the core and the envelope layer is equal to or greater than 2.0 mm and equal to or less than 3.8 mm;

an amount of compressive deformation Dm of a spherical body including the core, envelope layer and mid layer is equal to or greater than 1.8 mm and equal to or less than 3.8 mm; and an amount of compressive deformation Db of the golf ball is equal to or greater than 1.8 mm and equal to or less than 3.8 mm.

9. The golf ball according to claim 1, wherein the sum of the thickness Tm and the thickness Tc is equal to or less than 1.2 mm.

10. The golf ball according to claim 9, wherein the sum of the thickness Tm and the thickness Tc is equal to or less than 0.9 mm.

* * * * *